US005254060A

United States Patent [19]

Bohanan

[11] Patent Number: 5,254,060

[45] Date of Patent: Oct. 19, 1993

[54] MOTORIZED EXERCISER FOR HUMAN LIMBS

[76] Inventor: Larry H. Bohanan, 4501 Pleasant Ridge Rd., Knoxville, Tenn. 37912

[21] Appl. No.: 890,778

[22] Filed: Jun. 1, 1992

[51] Int. Cl.[5] ..... A63B 69/16

[52] U.S. Cl. ..... 482/60; 482/57; 482/62; 128/25 R

[58] Field of Search ..... 128/25 B, 25 C, 25 R, 128/21; 482/57, 62, 60, 7

[56] References Cited

U.S. PATENT DOCUMENTS

| | | | |
|---|---|---|---|
| 3,730,174 | 5/1973 | Madison . | |
| 3,911,908 | 10/1975 | Duke . | |
| 4,478,213 | 10/1984 | Redding . | |
| 4,587,960 | 5/1986 | Schotten . | |
| 4,615,335 | 10/1986 | Searcy . | |
| 4,637,379 | 1/1987 | Saringer . | |
| 4,717,146 | 1/1988 | Nohara . | |
| 4,844,454 | 7/1989 | Rogerts . | |
| 4,928,673 | 5/1990 | Heneger . | |
| 4,953,541 | 9/1990 | Parker, Jr. . | |
| 4,973,046 | 11/1990 | Maxwell . | |
| 4,993,407 | 2/1991 | Chen | 482/57 |
| 5,003,967 | 4/1991 | McConnell | 602/21 |
| 5,020,795 | 6/1991 | Airy et al. . | |
| 5,027,794 | 7/1991 | Pyle . | |

FOREIGN PATENT DOCUMENTS

| | | | |
|---|---|---|---|
| 2468360 | 5/1981 | France | 128/25 R |

*Primary Examiner*—Richard J. Apley
*Assistant Examiner*—Lynne A. Reichard
*Attorney, Agent, or Firm*—Pitts & Brittian

[57] ABSTRACT

A passive exercise unit for manipulating legs and/or arms of a patient to achieve improved circulation, development of muscles and achieve full extension of otherwise crippled limbs. A motor-driven crankshaft member carries leg cradles on opposite sides of a housing that is supported on a base. This base can be, if desired, releasable fastened to a bed supporting the patient. These cradles are pivotally supported, and their position relative to the crankshaft permits a selected degree of motion for the patient's legs. An upwardly-extending frame carries arm exercising components that include cables to hand grips. Motion for these cables is achieved by connections to the crankshaft used for the leg cradles. This frame can be folded against, or stored in, the housing when not in use. In a preferred embodiment there are glove units to assist in the holding of hand grips by the patient.

20 Claims, 6 Drawing Sheets

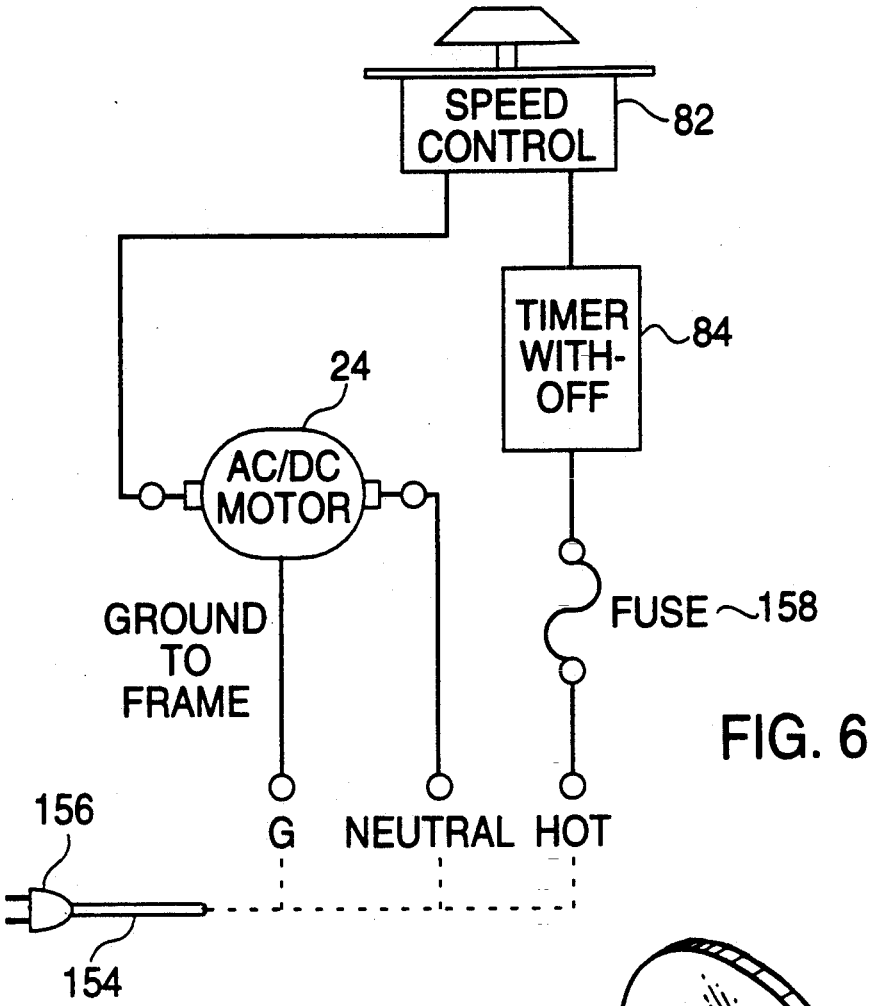
FIG. 6
FIG. 5
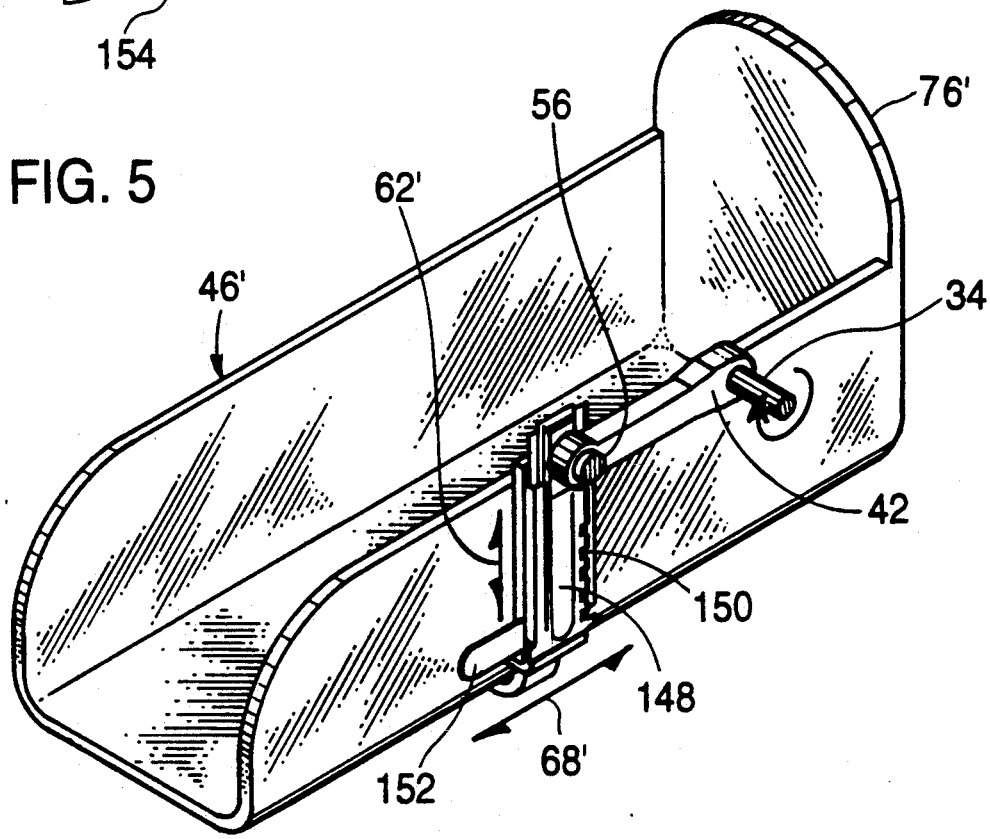

MOTORIZED EXERCISER FOR HUMAN LIMBS

DESCRIPTION

1. Technical Field

This invention relates to body exercisers, and more particularly to a motorized unit for exercising legs and/or arms of a patient to enhance blood circulation, strengthen the muscles of the patient and provide a range of joint motion to prevent joint "freeze-up". The unit is adaptable for use with the patient either in a chair or reclining in a bed.

2. Background Art

It is well recognized that exercise of bodily limbs greatly enhances the recovery process of individuals after surgery. Similarly, such exercise has been found to be beneficial to various types of handicapped persons through increased blood circulation and muscle strengthening. It is for these reasons that a wide variety of devices have been developed to bring about the desired exercise. Some of the devices are powered by the individual, these being considered "active" exercisers; and others are driven by appropriate driving means to result in the needed motions, these being considered as "passive" exercisers.

The following U. S. patents are typical of the devices that have been developed to be of assistance to patients: 3,730,174 issued to G. Madison on May 1, 1973; 3,911,908 issued to C. Duke on Oct. 14, 1975; 4,478,213 issued to D. Redding on Oct. 23, 1984; 4,587,960 issued to T. Schotten on May 13, 1986; 4,615,335 issued to C. Searcy on Oct. 7, 1986; 4,637,379 issued to H. Saringer on Jan. 20, 1987; 4,717,146 issued to H. Nohara on Jan. 5, 1988; 4,844,454 issued to S. Rogers on Jul. 4, 1989; 4,928,673 issued to F. Heneger on May 29, 1990; 4,953,541 issued to A. Parker on Sep. 4, 1990; 4,973,046 issued to H. Maxwell on Nov. 27, 1990; 5,020,795 issued to J. Airy et al. on Jun. 4, 1991; and 5,027,794 issued to G. Pyle on Jul. 2, 1991.

Most of the above-listed patents are passive-type exercisers in that they are motor driven. Most utilize some form of oppositely-disposed crank arms with foot pedals attached at the ends. As such, they are designed only for the exercise of the lower extremities of the patient and give no support for lower portion of the leg. At least one of the devices (4,717,146) can be used for either leg exercise or arm exercise, but not at the same time.

Accordingly, it is an object of the present invention to provide a motorized exercising device that permits individual exercise of the arms or the legs, or the arms and legs simultaneously, of a patient.

It is another object of the present invention to provide a passive exerciser where individual or joint leg and arm exercise are accomplished by the same portion of the device.

Another object of the present invention is to provide a passive exerciser where the portion for leg exercise is separated from that for arm exercise, with either or both portions being used by a patient.

A further object of the present invention is to provide a passive exerciser where the portion useful for arm exercising is adjustable in height relative to the shoulders of a patient to enhance certain muscle strengthening and provide a selected range of joint motion.

Still another object of the present invention is to provide a passive exerciser where there is support for the lower leg, with the support being sufficiently pivotable so as to prevent stress on the knee.

These and other objects of the present invention will become apparent upon a consideration of the accompanying drawings and a complete description thereof.

DISCLOSURE OF THE INVENTION

In accordance with the present invention, there is a passive exercising device that has a base for support on the floor or upon a bed, with an upstanding housing on the base to contain the drive system. The drive system causes rotation of a double ended shaft that projects on opposite sides of the housing substantially parallel with the surface of the base. Attached to the opposite ends of the shaft are oppositely-directed crank arms that are caused to move in planes perpendicular to the shaft while pivoting around the shaft. An outwardly-directed axle on each crank arm pivotally supports a leg support cradle whereby the cradle will move in a motion similar to a bicycle, with the cradle pivotally supported so as to prevent stress on the knee joint. In one embodiment a hand grip is associated with each leg support cradle whereby arm exercise can be achieved during leg exercise. In another embodiment, hand grips are associated with auxiliary apparatus on an adjustable frame mounted to the housing, with this frame being adjustable with respect to a height of the shoulders of a patient. This adjustable arm exercising apparatus is manipulated by the drive system used to drive the crank arms.

BRIEF DESCRIPTION OF THE DRAWINGS

FIG. 5 is a drawing illustrating another embodiment of a leg support cradle as attached to a drive system of either FIG. 1 or FIG. 2.

FIG. 6 is a schematic circuit drawing of the electrical system of the embodiments of FIGS. 1 and 2.

BEST MODE FOR CARRYING OUT THE INVENTION

Figure 1:
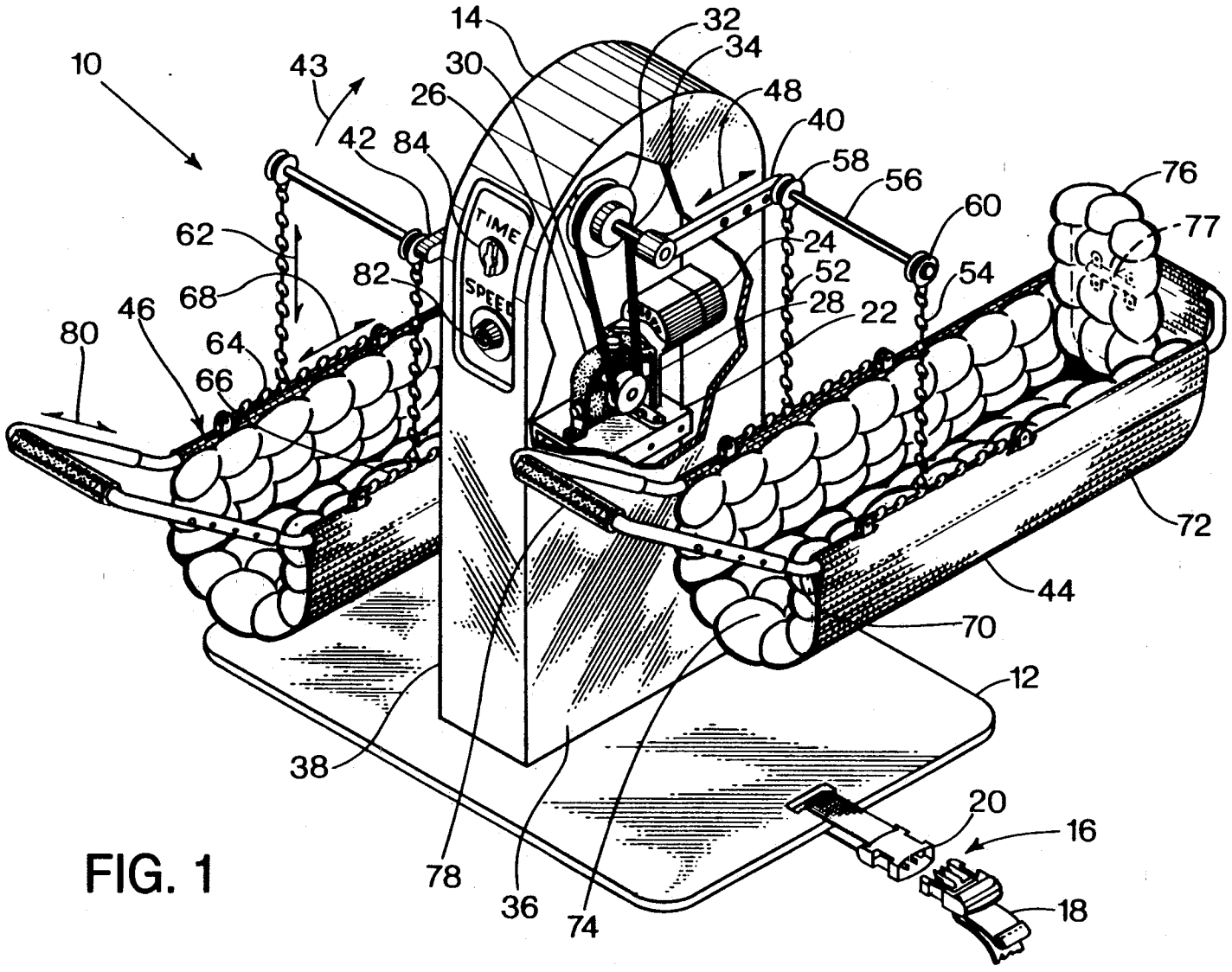
FIG. 1 is a perspective elevational view, partially cut away, of one embodiment of the present invention.

Shown generally at 10 in FIG. 1 is one embodiment of the present invention. A base 12, which is substantially planar, supports an upright housing 14. The base 12 permits the unit to be supported on the floor or, in the case illustrated, on a bed mattress (see FIG. 3). In order to prevent movement of the base 12 on a bed, a restraining strap unit 16 with a strap 18 and clasp 20 are provided to encircle the mattress. When the base 12 rests on a floor in front of a chair (or wheel chair), an appropriate restraining element (not shown) may be desirable to prevent movement relative to the chair.

Positioned within the housing 14, as mounted from a bracket 22, is an electrical drive motor 24 coupled with a transmission 26. It will be recognized that if a motor of proper speed is used, there will be no necessity for use of the transmission 26. The transmission 26 is used to drive a pulley element 28 which through the effect of belt 30, drives a second pulley 32. This second pulley is affixed to a double-ended shaft 34 that is appropriately journalled in bearings (not shown) within the housing 14. Opposite ends of the shaft 34 project from sides 36, 38 of the housing 14 where they receive oppositely-directed crank arms 40, 42. This orientation provides that the crank arms 40, 42 move in planes substantially perpendicular to the axis of the shaft 34 as indicated with the arrow 43.

Mounted to each of the crank arms 40, 42 at a selected distance from the shaft 34 is a leg support cradle 44, 46. The double-ended arrow 48 is indicative that this distance is selectable. Each of these leg support cradles 44, 46 is substantially identical so that details of only one are given. The leg support cradle 44 is supported by chain members 52, 54 each pivotally engaged with an axle 56 at 58, 60. The length of these chain members 52, 54 is selectable as indicated by the double-ended arrow 62 (at cradle 46). The opposite ends of the chain members 52, 54 are joined at selectable positions along second chain members 64, 66 as indicated by the double-ended arrow 68. It will be understood that chain members 52, 54, 64 and 66 are examples of flexible supports, and that other supports that provide flexibility and adjustability can also be utilized in the present invention. As will be discussed herein after, these various adjustments control the degree of movement of the leg support cradles 44, 46 and allow for leg movement without placing undue stress on the knee joint. The cradles 44, 46 are typically fabricated with a rigid frame 70, at least a semi-rigid external body 72 and a padded interior 74. Each are provided with a foot rest 76 and with a removable hand grip 78. The foot rest 76 can be pivotally mounted from the frame 70 as indicated at 77. The hand grip 78 can be positioned at selected distances from the body 72 as indicated by the double-ended arrow 80.

Although not shown in this FIG. 1, there is an electrical cable for powering the motor 24 (see FIG. 6). Speed of the motor 24 can be controlled by a selector switch 82, which can include on/off positions, and the duration of operation is controllable with a timer 84.

In a typical utilization of the embodiment of FIG. 1, one or both legs of a patient are placed in their respective leg support cradles 44, 46 with the feet placed proximate the foot rest 76. The effective lengths of the crank arms 40, 42, as well as the length of the chains 52, 54, 64 and 66, are adjusted for the desired degree of movement of the legs. If the hand grips 78 are to be used, their position is also selected. If the patient is reclining or semi-reclining on a bed, the base member 12 is placed on the mattress and the unit is secured by the strap unit 16. However, if the patient is positioned in a Chair, the base member 12 is placed on the floor. With the leg (or legs) in the cradles, the unit is energized at a selected speed and time duration using the controls 82, 84. The motion of the crank arms 40, 42 in the direction of arrow 43 causes the lower limbs to be exercised to improve circulation, exercise muscles and generally be beneficial to the patient. When the hand grips 78 are held by the patient, arm movements occur that further are beneficial to the patient. It will be understood that one or both of the leg support cradles 44, 46 and hand grips 78 can be used at one time. The motion and position of the components can provide for full extension of the limbs to give maximum exercise.

There are applications for an exerciser where benefit is derived from having arm motion at a higher elevation than is possible with the embodiment of FIG. 1. Accordingly, a modified embodiment is shown generally at 10' in FIG. 2. Elements of this embodiment that are substantially like their corresponding elements of FIG. 1 carry the same numbers. Elements that are only slightly different in configuration carry primed numbers. Thus, there is a base member 12 and an upstanding housing 14. If desired, the base member 12 can be provided with a strap unit 16 to attach the base member to a bed, etc., or with some attaching element to the chair. A drive system in the form of a motor 24' and transmission 26' (if required) are mounted on a support 22'. In this embodiment the double-ended shaft 34' is directly driven by the transmission 26' It will be recognized by persons skilled in the art that a double-ended shaft motor of proper speed can be used without use of a transmission (and belt of FIG. 1).

The speed and time duration of operation is selectable with controls 82, 84. This embodiment illustrates the variation of placing these controls 82, 84 in a removable unit 86 that can be placed near the patient. Thus, there is provided an electrical umbilical cord 88.

The leg support cradles 44 and 46 in this embodiment are supported in a slightly different manner than the embodiment of FIG. 1. The chains 52', 54' are joined at an upper end to a ring member 90, with this ring member 90 engaged with the axle 56 as at 60. The functioning, however, is similar to that of the embodiment of FIG. 1.

Figure 2:
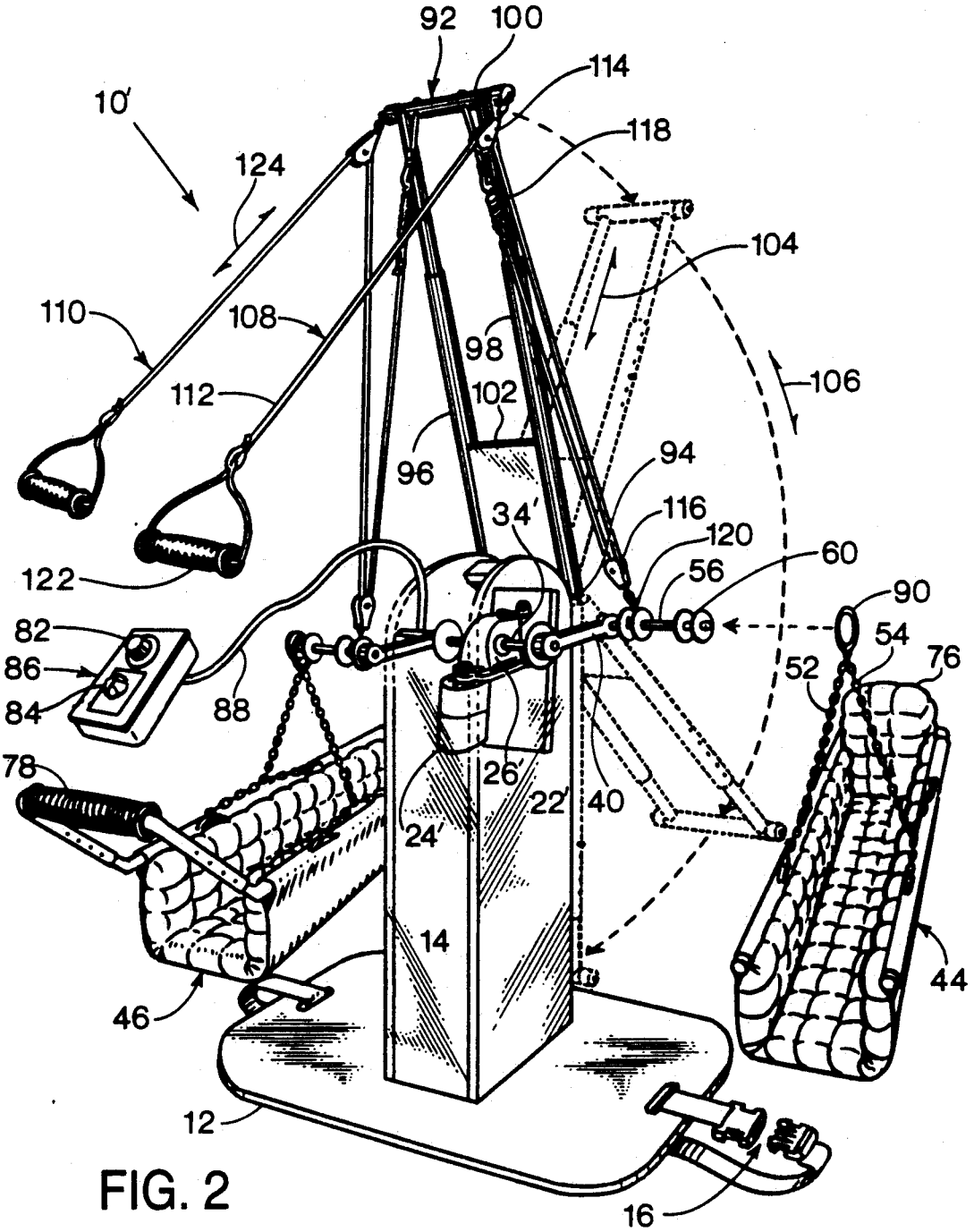
FIG. 2 is a perspective elevational view, partially cut away, of another embodiment of the present invention in which a separate arm exercising frame is incorporated into the design of the embodiment of FIG. 1.

The embodiment of FIG. 2 provides for an alternate form of arm exercising. This provision is available using a frame member 92 that is pivotally joined to the housing 14 as at 94. Although not shown, there is a locking element to selectively fasten the frame member 92 at a selected pivotal position with regard to the housing 14. Further this frame member 92, which is formed by legs 96, 98, and crossmembers 100, 102 is adjustable in length as indicated by the double ended arrow 104. During pivotal movement, the frame member 92 moves in the direction indicated by the double ended arrow 106 from a stored position proximate the housing 14 (as illustrated in dashed lines) to an extended position as illustrated in solid lines. A pair of arm exerciser units 108, 110 are supported from this frame member 92. Each of these arm exerciser units 108, 110 is identical, and each have a flexible but non-extendable cable member The cable member 112 passes through a pulley 114 proximate the cross member 100, then through a second pulley 116 and returns to the frame member 92 again proximate the cross member 100 where it is attached as with a spring member 118. The second pulley 116 is pivotally joined to the axle 56 on the crank arm 40,, as at 120. The unattached end of the cable member 112 carries a hand grip 122. This particular construction provides for generally axial movement, as indicated by the double ended arrow 124, of the hand grip 122 that is twice the throw (the distance between the axis of the shaft and the axis of the axle) of the axle 56. Of course, other combinations of mechanical advantage can be utilized to give a desired movement of the hand grip 122 such that full extension of the arm can be achieved for maximum beneficial exercise. It will be understood that due to the flexibility of the cable units 110 and 112, a user can move the hand grips 122 away from each other to get further shoulder exercise. It will be recognized that when the hand grip 122 is being used, the grip 78 on the leg cradle 46 can be removed if desired.

Figure 3:
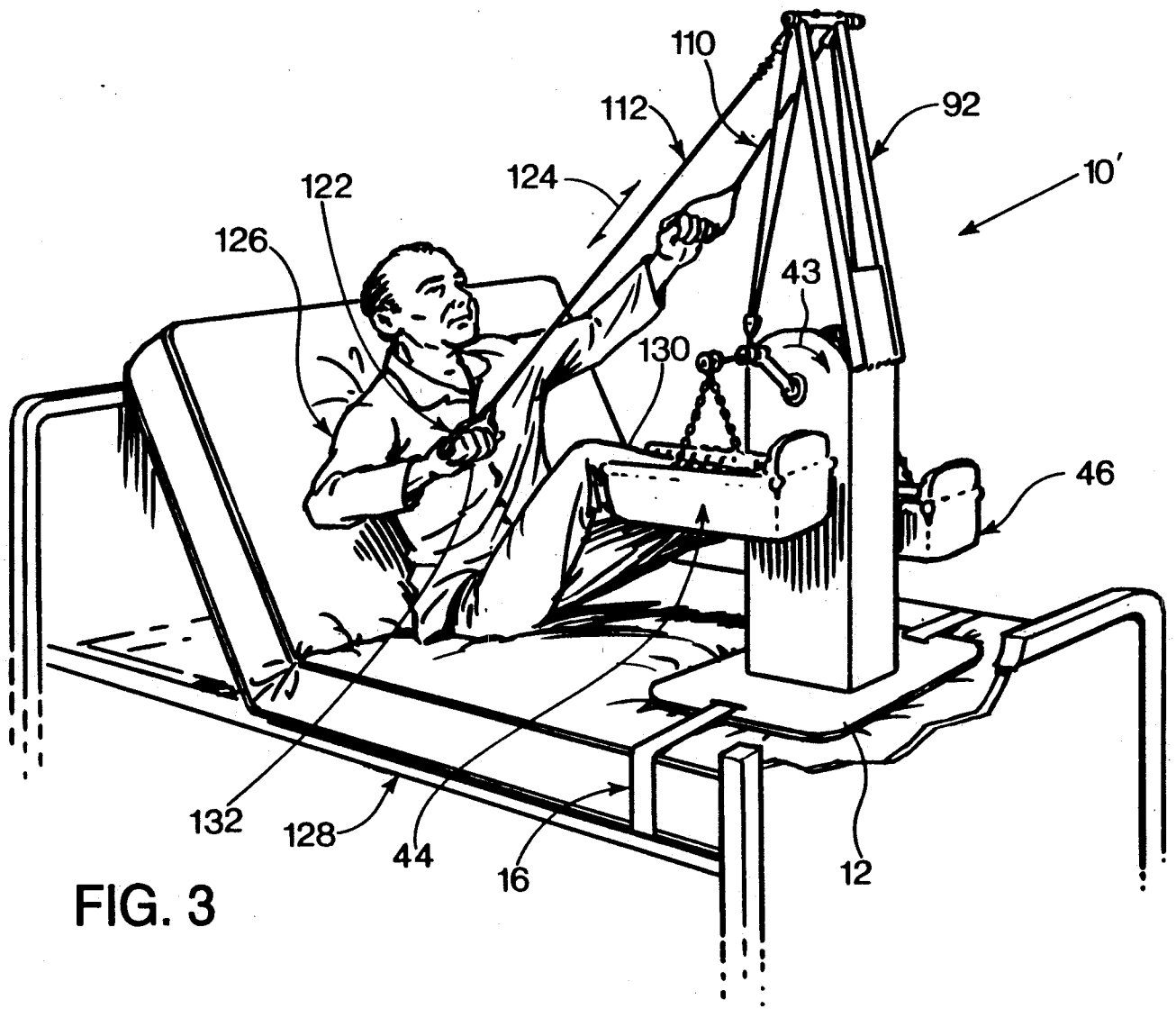
FIG. 3 is a drawing illustrating the use of the embodiment of FIG. 2 by a patient reclining in a bed.

A typical utilization of the embodiment 10' of FIG. 2 is illustrated in FIG. 3. A patient 126 is semi-reclining on a bed 128 with the base member 12 being secured to the bed with the strap unit 16. The leg 130 of the patient 126 is supported in the leg support cradle 44 (the other leg being in cradle 46 if both legs are to be exercised). Further, the patient 126 is grasping the hand grip 122 of the cable unit 112 with his hand 132 (the other hand grasping the grip on the second cable unit 110). It will be recognized that only one of the leg cradle supports 44, 46 and cable units 110, 112 can be used, and those individually, for desired exercising. It will be recognized that this embodiment 10' can also be used with a patient supported in a chair and the base member 12 supported on the floor.

Figure 4:
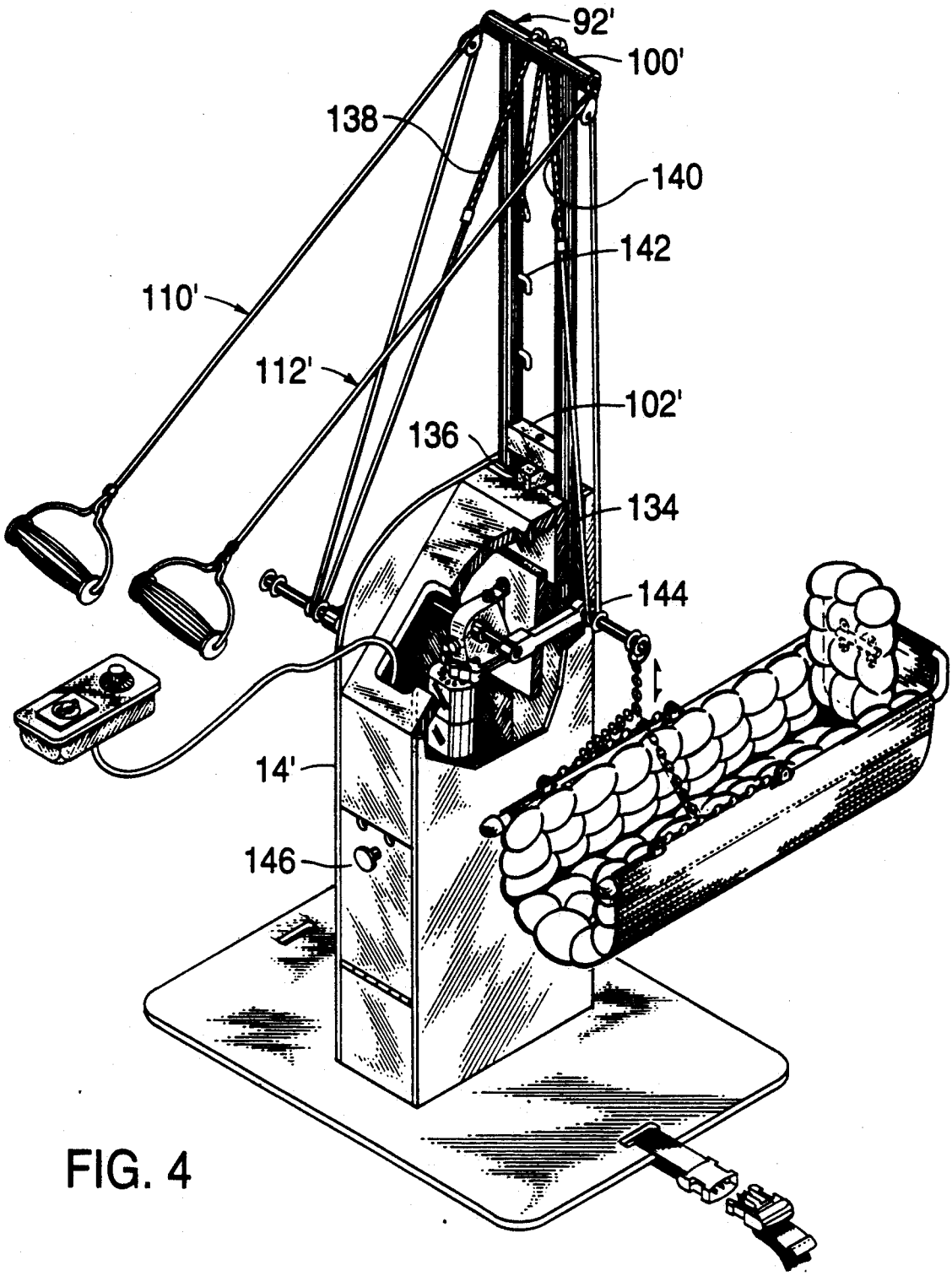
FIG. 4 is a perspective elevational view, partially cut away, of another embodiment of the present invention showing a further embodiment of a separate arm exercising frame.

Shown in FIG. 4 is an alternate embodiment for giving full extension of arm movement as well as any leg movements. This differs in the frame 92' and the arm exercising cables 110', and 112'. With regard to the frame 92', rather than pivot with respect to a housing, this embodiment provides for storage of the frame 92' within the housing 14'. This is accomplished by providing a slideway 134 such that the frame 92' can be raised from, or stored in, the housing '. A lock member 136 on the cross arm 102' holds the frame 92' in the extended position as shown. Rotation of this lock member 136 so as to be aligned with the cross arm 102' allows the frame 92' to be lowered into the housing 14'.

The embodiment of FIG. 4 eliminates the spring units 118 of FIG. 2. Rather, elastic members 138, 140 are incorporated at the ends of cables 110', 112'. These elastic members pass over the cross member 100' and ends engage one of a selected number of hook units 142 or corresponding attachment points. This permits adjustment of the total length of the cables 110' and 112' to achieve full extension of the arms of a patient using the machine. This embodiment further eliminates pulley 120 and, in its place, the cables 110' and 112' encircle the axles 56 as at 144. A bin 146 is provided in housing 14' for storage of ancillary equipment, such as a power cord for the unit.

FIGS. 2–4 depict pulley units, e.g., 112, 114, that permit axial movement of the two cable units 108, 110. It will be recognized, however, that other forms of rotatable members serving the same function can be utilized with the exercising device of the present invention.

The embodiments of FIGS. 1, 2 and 4 utilize chain elements 52, 54 to adjust the leg cradles 44, 46 in relationship to the crank arms 40, 42. An alternate construction is illustrated in FIG. 5 which also shows a modified leg support cradle 46'. This cradle 46' pivots around axle 56 through the use of an arm 148 that is adjustable in length. Typically this arm 148 is provided with a toothed edge 150 that receives a detent (not shown) operated by a lever 152. Thus, an unlocking of the detent by rotation of the lever 152 permits adjustment of the linkage length of the arm 148 and thus the position of the cradle 46' with respect to the axle 56. This length is designated by the double-ended arrow 62'. The arm 148 extends beneath the cradle 46' where its position can be adjusted to give the lengthwise adjustment indicated by the double-ended arrow 68'. It will be recognized that other mechanical forms of adjustment can be substituted for that shown in this figure. Thus, the leg cradle 46' (and a similar leg cradle 44' on the opposite side) can be adjusted for a given patient such that natural movement of the knee is effected to prevent undue strain. It will be understood that the operation of this embodiment will provide the same exercise for the legs as described with respect to FIGS. 1–3.

A schematic circuit diagram of the present invention is depicted in FIG. 6 which is applicable to the embodiments of FIGS. 1, 2 and 4. A power cord 154, which terminates in a plug 156 adapted for engagement with a conventional receptacle (not shown) provides power to components within the housing 12 (see FIGS. 1 and 2). This power is fed to the motor 24 (or 24') through the timer unit 84 and speed control 82. An "on/off" switch is illustrated as being part of the timer unit 84; however, a separate switch can be inserted in the circuit if desired. Preferably there is a fuse 158 or other overload protective device in the system.

Figure 7:
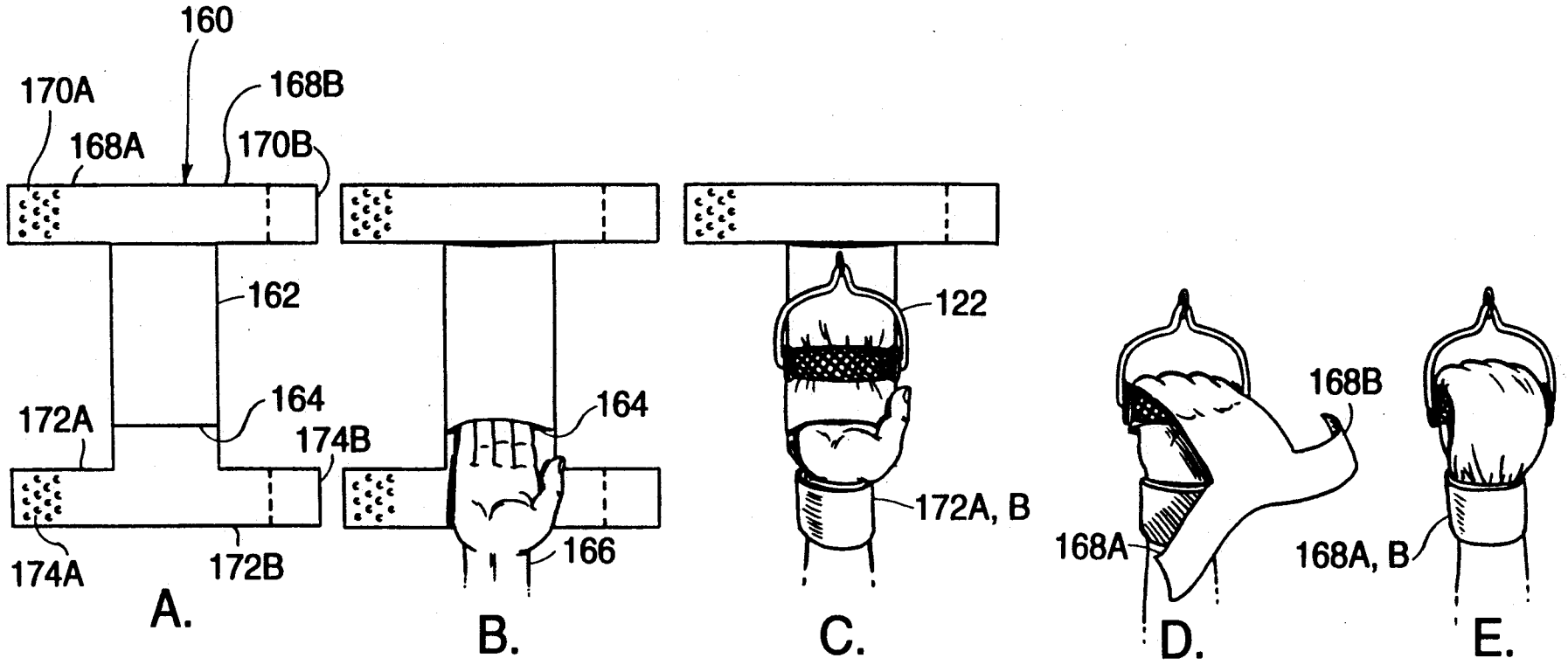
FIGS. 7A through 7E depict the use of a strap to be used to ensure grasp of a hand grip of the embodiments of FIGS. 1–3 by the hand of a patient, particularly where the patient has insufficient control of hand/finger muscles.

Some patients, due to their disabilities, will not be able to securely grasp a hand grip (78 or 122 of FIGS. 1–4). In order that such patients can utilize the present invention, a gripping glove 160 is illustrated in FIG. 7. Referring first to FIGS. 7A and B, this glove 160 is generally I-shaped having a generally rectangular body portion 162 that defines a pocket 164 for receipt of the hand 166 of a patient. A distal end of the body portion 162 carries a pair of oppositely-directed flaps 168A, 168B. One of these flaps (e.g., 168A) is provided with the loop portion 170A of a hook-and-loop fastener (e.g., Velcro), with the other flap being provided with the cooperating hook portion 170B. The opposite end of the body portion 162 is also provided with a pair of oppositely-directed flaps 172A, 172B: one being provided with the loop portion 174A of a hook-and-loop fastener, with the other flap of the pair being provided with the hook portion 174B. Of course, other fastening means can be used, such as straps with buckles, for example.

In FIG. 7C is illustrated how the flaps 172A, 172B are wrapped around the patient's wrist 166 after the hand has been inserted in the pocket 164. In FIG. 7D it can be seen that the remainder of the glove 160 is threaded through the hand grip 122 with the fingers bent, and in FIG. 7E the flaps 168A and 168B are overlapped so as to secure the patient's hand on the hand grip 122. It will be understood that this glove unit 160 can also be used to assist in the grasp of the hand grip 78 of FIGS. 1–3. Further, the glove unit 160 can be used wherever a hand is to be similarly secured.

From the foregoing it will be recognized by persons skilled in the art that a universal exerciser for the limbs of a patient has been developed. The degree of motion of both the legs and arms of a patient are adjustable so as to get up to full extension of either. Such a device provides this extension, and the exercise useful for improving circulation and developing muscles. Even persons who cannot normally hold a hand grip can use the device through the use of the glove unit. The device permits use of either or both of the leg support cradles and/or use of either or both of the arm exercising portions.

Although certain specific recitations of components are used for illustration of the present invention, these are not for limiting the invention. Rather, the invention is to be limited only by the appended claims and their equivalents.

I claim:

1. A passive exercising unit for manipulating limbs of a patient to achieve improved circulation, development of muscles and achieve full extension of the limbs, said unit comprising:

a base member;

an upstanding housing member mounted upon said base member, said housing member having front and back surfaces and oppositely disposed side surfaces;

a drive means within said housing member, said drive means including a rotatable shaft extending from each of said oppositely disposed side surfaces of said housing member and means to rotate said shaft;

a pair of crank arms, each of said crank arms having a first end and a distal end, said first end of a first of said crank arms attached at said first end to said shaft exterior one of said oppositely disposed sides of said housing member and a second of said crank arms attached at said first end to said shaft exterior a second of said oppositely disposed sides of said housing member, said first crank arm directed oppositely to said second crank arm;

a first leg cradle support unit pivotally and releasably mounted from said distal end of said first crank arm, said first leg cradle adapted to support substantially all of a lower leg portion of a patient, said first leg cradle provided with means for adjusting a distance toward said base member from said first leg cradle to said distal end of said first crank arm; and a second leg cradle support unit pivotally and releasably mounted from said distal end of said second crank arm, said second leg cradle adapted to support substantially all of a second lower leg portion of the patient, said second leg cradle provided with means for adjusting a distance toward said base member from said second leg cradle to said distal end of said second crank arm;

wherein said means for adjusting distance between each of said leg support cradles and said respective of said distal ends of said crank arms comprises a selectable length of a flexible member having a first end pivotally attached to an axle mounted orthogonally from said distal end of said crank arm, and a second end pivotally attached to a selected position on said leg support cradle.

2. The exercising unit of claim 1 further comprising hand grips individually and releasably mounted on said first and second leg cradle support units to be grasped by hands of the patient whereby movement of said leg cradle support units achieves exercise of arms of said patient, said hand grips provided with means for adjusting a distance from said leg cradles to said hand grips.

3. The exercising unit of claim 1 wherein said means for rotating said shaft is an electric motor, means coupling said motor to said shaft, and means to selectively energize said motor.

4. The exercising unit of claim 3 wherein said means to selectively energize said motor comprises:

a timer means for adjusting a time duration of energization of said motor;

a speed control means for adjusting a rotational speed of said motor and thus said shaft; and an electrical power supply connected to said timer means, to said speed control means and to said motor.

5. The exercising unit of claim 4 wherein said timer means and said speed control means are mounted in said housing member.

6. The exercising unit of claim 1 further comprising:

a frame member adapted to be extended from said housing member in a direction away from said base member, said frame member having a first end and a distal end, said first end connected to said housing member;

a first and a second rotatable member carried by said distal end of said frame member;

a first flexible cable member operationally engaged with said first rotatable member, said first cable member having a first end carrying a hand grip to be grasped by the patient, said first cable member rotatably engaged with said distal end of said first crank arm whereby rotation of said first crank arm around said shaft produces axial movement of said first cable member; and a second flexible cable member operationally engaged with said second rotatable member, said second cable member having a first end attached to a second hand grip to be grasped by the patient, said second cable member engaged with said distal end of said second crank arm whereby rotation of said second crank arm around said shaft produces axial movement of said second cable member.

7. The exercising unit of claim 6 wherein said first and second cable members each include an elastic element to prevent mechanical shock to arms of the patient as each of said first and second cable members are moved axially by said crank arms, and wherein each said first and second cable members have a second end attached to said distal end of said frame member and each said first and second cable members have a bight portion between said first end and said second end that is rotatably engaged with respective of said axles at said distal ends of said crank arms.

8. The exercising unit of claim 1 further comprising strap means engaged with said base member, said strap means including releasable buckle means, for releasably engaging said base member with a bed supporting the patient.

9. The exercising unit of claim 6 further comprising a hand retaining glove to ensure grasp of said hand grip by a hand of the patient, said glove comprising:

a generally rectangular body portion, said body portion defining a pocket to receive a hand;

a first pair of oppositely directed tabs at a first end of said body portion, said first pair of tabs provided with cooperating fastener elements whereby said first pair of tabs can encircle a wrist of the hand and engage each other; and a second pair of oppositely directed tabs at a second end of said body portion, said second pair of tabs provided with cooperating fasteners whereby said second pair of tabs can encircle the wrist of the hand and engage each other;

whereby when fingers of the hand engage said hand grip and said first and second pair of tabs are engaged around the wrist, the hand is securely engaged with said hand grip.

10. A passive exercising unit for manipulating limbs of a patient to achieve improved circulation, development of muscles and achieve full extension of the limbs of the patient, said unit comprising:

a base member;

an upstanding housing member mounted upon said base member, said housing member having front and back surfaces and oppositely disposed side surfaces;

a drive means within said housing member, said drive means including a rotatable shaft extending from each said oppositely disposed side surfaces of said housing member, an electric motor, means to connect said motor to said shaft to rotate said shaft and a power source for said motor;

a pair of crank arms, each of said crank arms having a first end and a distal end, a first of said crank arms attached at said first end to said shaft exterior one of said oppositely disposed side surfaces of said housing member and a second of said crank arms attached at said first end to said shaft exterior a second of said oppositely disposed side surfaces of said housing member, said first crank arm directed oppositely to said second crank arm;

a first leg cradle support unit pivotally and releasably mounted from said distal end of said first crank arm, said first leg cradle adapted to support substantially all of a lower leg portion of a patient, said first leg cradle provided with means for adjusting a distance toward said base member from said first leg cradle to said distal end of said first crank arm;

a second leg cradle support unit pivotally and releasably mounted from said distal end of said second crank arm, said second leg cradle adapted to support substantially all of a second lower leg portion of the patient, said second leg cradle provided with means for adjusting a distance toward said base member from said second leg cradle to said distal end of said second crank arm;

a frame member adapted to be extended from said housing member in a direction away from said base member, said frame member having a first end and a distal end, said first end connected to said housing member;

a first and a second rotatable member carried by said distal end of said frame member;

a first flexible cable member engaged with said first rotatable member, said first cable member having a first end, a distal end and a bight portion between said first end and said distal end, said first end attached proximate said distal end of said frame member, said bight portion rotatable engaged with said first crank arm proximate said distal end of said first crank arm, and said distal end of said first cable member attached to a hand grip; and a second flexible cable member engaged with said second rotatable member, said second cable member having a first end, a distal end and a bight portion between said first end and said distal end, said first end attached proximate said distal end of said frame member, said bight portion rotatable engaged with said second crank arm proximate said distal end of said second crank arm, and said distal end of said second cable member attached to a second hand grip;

whereby said first and second flexible cable members are moved axially to provide motion of said first and second hand grips, respectively, that is twice a distance between an axis of said shaft and said distal end of said crank arms.

11. The exercising unit of claim 10 wherein said first and second cable members each include an elastic element to prevent mechanical shock to arms of the patient as each of said first and second cable members are moved axially by said crank arms.

12. The exercising unit of claim 10 further comprising further hand grips individually and releasably mounted on said first and second leg cradle support units to be grasped by hands of the patient whereby movement of said leg cradle support units achieves exercise of arms of the patient, said further hand grips provided with means for adjusting a distance from said leg cradles to said further hand grips.

13. The exercising unit of claim 10 wherein said housing member is provided with a receptacle to slidably receive said frame member for storage of said frame member when not in use.

14. The exercising unit of claim 10 wherein said frame member is hinged at said first end to said housing member whereby said frame member can be folded against said housing member when not in use.

15. The exercising unit of claim 10 further comprising a hand retaining glove to ensure grasp of said hand grip by a hand of said patient, said glove comprising:

a generally rectangular body portion, said body portion defining a pocket to receive the hand;

a first pair of oppositely directed tabs at a first end of said body portion, said first pair of tabs provided with cooperating fastener elements whereby said first pair of tabs can encircle a wrist of the hand and engage each other; and a second pair of oppositely directed tabs at a second end of said body portion, said second pair of tabs provided with cooperating fasteners whereby said second pair of tabs can encircle the wrist of the hand and engage each other;

whereby when fingers of the hand engage said hand grip and said first and second pairs of tabs are engaged around the wrist, the hand is securely engaged with said hand grip.

16. A passive exercising unit for manipulating limbs of a patient to achieve improved circulation, development of muscles and achieve full extension of the limbs, said unit comprising:

a base member;

an upstanding support structure mounted upon said base member;

a drive means supported from said support structure, said drive means including a rotatable shaft oriented parallel with said base member, said shaft having first and second ends extending outwardly relative to said support structure, and means to rotate said shaft;

a pair of crank arms, each of said crank arms having a first end and a distal end, a first of said crank arms attached at said first end to said first end of said shaft, and a second of said crank arms attached at said first end to said second end of said shaft, said first crank arm directed oppositely to said second crank arm;

a first leg cradle support unit pivotally and releasably mounted from said distal end of said first crank arm, said first leg cradle adapted to support substantially all of a lower leg portion of the patient, said first leg cradle provided with means for adjusting a distance toward said base member from said first leg cradle to said distal end of said first crank arm; and a second leg cradle support unit pivotally and releasably mounted form said distal end of said second crank arm, said second leg cradle adapted to support substantially all of a lower leg portion of the patient, said second leg cradle provided with means for adjusting a distance toward said base member from said second leg cradle to said distal end of said second crank arm;

wherein said means for adjusting distance between each of said leg support cradles and respective of said distal ends of said crank arms comprises a selectable length of a flexible member having a first end pivotally attached to an axle mounted orthogonally from said distal end of said crank arm, and a second end pivotally attached to a selected position on said leg support cradle along a length of said leg support cradle.

17. The unit of claim 16 wherein said support structure is an enclosed housing member and wherein said drive means is supported within said housing member.

18. A leg cradle support unit for use with a passive exercising unit for manipulating lower limbs of a patient to achieve improved circulation, development of muscles and achieve full extension of the lower limbs, the exercising unit having a transverse rotatable shaft with oppositely disposed crank arms having first ends attached substantially orthogonally at each end of the shaft, and with distal ends, each of the crank arms having an axle at the distal ends substantially orthogonal to the crank arms, said leg cradle support unit comprising:

a substantially rigid body member to support substantially all of a lower leg portion of a patient, said body member having a first end and a second end;

a foot rest mounted at said second end of said body member;

an adjustment means for selecting a spacing between said body member and an axle on the distal end of the crank arm, said adjustment means being a length of a flexible member having a first end rotatably attached to the axle and a second end pivotally attached to said body member at selected locations between said first and second ends of said body member whereby said body member can pivot with respect to said adjustment means due to bending of the leg of the patient during rotation of the shaft and crank arm.

19. The leg support cradle of claim 18 wherein said foot rest is pivotally mounted from said body member.

20. An arm manipulating unit for use with a passive exercising unit for manipulating arms and shoulders of a patient to achieve improved circulation, development of muscles and achieve full extension of the limbs, the exercising unit having a support structure mounted on a base member and a transverse rotatable shaft with oppositely disposed crank arms having first ends attached substantially orthogonally at each end of the shaft, and with distal ends, each of the crank arms having an axle at the distal ends substantially orthogonal to the crank arms, said arm manipulating unit comprising:

a frame member adapted to be extended from the support structure in a direction away from a base member, said frame member having a first end and a distal end, said first end connected to a support structure;

a first and a second rotatable member carried by said distal end of said frame member;

a first flexible cable member operationally engaged with said first rotatable member, said first cable member having a first end carrying a hand grip to be grasped by a patient and a second end attached to said frame member, and a bight portion of said first cable member rotationally engaged with an axle at a distal end of a first of the crank arms whereby rotation of the first crank arm around the shaft produces axial movement of said first cable member and thus movement of said first hand grip; and a second flexible cable member operationally engaged with said second rotatable member, said second cable member having a first end attached to a second hand grip to be grasped by the patient and a second end attached to said frame member, and a bight portion of said second cable member rotatably engaged with an axle at a distal end of a second of the crank arms whereby rotation of the second crank arm around the shaft produces axial movement of said second cable member and thus movement of said second hand grip;

whereby said first and second hand grips have movement that is twice the distance between the axles attached to the distal ends of the crank arms and an axis of said shaft.

* * * * *